US005630733A

United States Patent [19]

Jinno et al.

[11] Patent Number: 5,630,733

[45] Date of Patent: May 20, 1997

[54] FEMALE TERMINAL

[75] Inventors: Keishi Jinno; Sakai Yagi, both of Shizuoka, Japan

[73] Assignee: Yazaki Corporation, Tokyo, Japan

[21] Appl. No.: 433,207

[22] Filed: May 2, 1995

[51] Int. Cl.[6] ..... H01R 13/40

[52] U.S. Cl. ..... 439/595

[58] Field of Search ..... 439/752, 843, 439/850, 595

[56] References Cited

U.S. PATENT DOCUMENTS

| | | | |
|---|---|---|---|
| 5,116,236 | 5/1992 | Colleran et al. | 439/752 |
| 5,145,419 | 9/1992 | Yamanashi et al. | 439/752 |
| 5,226,842 | 7/1993 | Endo et al. | 439/843 |

FOREIGN PATENT DOCUMENTS

| | | | |
|---|---|---|---|
| 3004171 | 8/1980 | Germany | 439/752 |
| 0160386 | 6/1990 | Japan | 439/595 |

*Primary Examiner*—Neil Abrams

*Assistant Examiner*—Eugene G. Byrd

*Attorney, Agent, or Firm*—Sughrue, Mion, Zinn, Macpeak & Seas

[57] ABSTRACT

A female terminal has an electrical contact portion of a cross-sectionally square, tubular configuration, and one wall of this electrical contact portion serves as a retaining wall. A retaining hole is formed through the retaining wall generally centrally of the width thereof, and a notch of a rectangular shape is formed in a central portion of this retaining wall at a front end thereof. Slanting piece portions are formed at the front end of the female terminal, and are disposed respectively on opposite sides of the notch, the slanting piece portions being curved inwardly relative to the cross-sectionally square, tubular portion. When the female terminal is inserted into a terminal receiving chamber in a housing, the slanting piece portions, provided respectively on the opposite side of the notch, elastically deforms an elastic retaining lance provided in the housing, and when the retaining lance becomes fitted in the retaining hole, the female terminal is retained in a predetermined position in the housing.

2 Claims, 3 Drawing Sheets

FEMALE TERMINAL

BACKGROUND OF THE INVENTION

1. Field of the Invention

This invention relates to a female terminal which is connected to an end of a wire harness, used in an automobile or the like, and is fitted into a connector housing (hereinafter referred to merely as "housing"), and more particularly to a female terminal which is easily insertable into a terminal receiving chamber in the housing.

2. Related Art

Usually, a connection terminal is inserted into a housing and retained in a terminal receiving chamber in the housing, and then this terminal is fitted to a mating connection terminal to make an electrical connection therebetween. Therefore, the connection terminal, when fitted to the mating connection terminal, needs to be retained by a suitable retaining means so that it will not be easily moved in the terminal receiving chamber.

Generally, an elastic retaining lance of the cantilever type having one free end is formed on at least one inner surface of the terminal receiving chamber, and this free end of the retaining lance retainingly engages a predetermined portion of the connection terminal to fix the connection terminal within the terminal receiving chamber.

The process of insertion of a conventional female terminal into a housing will now be described with reference to FIGS. 6 to 8. As shown in FIG. 6, the female terminal 20 has an electrical contact portion 20*b* of a cross-sectionally square, tubular configuration at its front portion, and a wire connection portion 20*a* at its rear portion.

For mounting the female terminal 20 in the housing 11, the female terminal 20 is first inserted into a terminal receiving chamber 14 in the housing 11 from the rear end (right end in the drawings) of this housing.

As shown in FIG. 7, a retaining hole 22 of a rectangular shape is formed through one side wall (retaining wall) 20*c* of the electrical contact portion 20*b* of a cross-sectionally square, tubular shape, and is disposed centrally of the width of the side wall 20*c*.

A resilient contact plate 28 for securing an electrical contact between the female terminal and a male terminal (not shown) is provided within the electrical contact portion 20*b*. This resilient contact plate 28 is mounted on the female terminal 20 in the process of producing this terminal. A continuous plate constituting the resilient contact plate 28 is inserted into the cross-sectionally square, tubular portion by the use of a mounting tool, and then is cut at that portion thereof which defines one end of the resulting contact plate 28, and then this contact plate is secured to the tubular portion. Therefore, a notch 24 of a rectangular shape, serving as a tool insertion hole for passing the mounting tool therethrough is formed in a front end of the retaining wall 20*c*.

The conventional female terminal 20 of the above construction, when inserted into the housing 11, advances in the terminal receiving chamber in a direction of arrow Z as shown in FIG. 8, so that front edges 23*a* and 23*a* of the opposite side portions of the front end of the female terminal spaced from each other by the notch 24 are brought into contact with a slanting surface 12*a* formed on an elastic retaining lance 12 provided on the housing 11.

In this condition, when the female terminal 20 is further advanced in the direction of arrow Z, the front edges 23*a* and 23*a* on the female terminal 20 urge the elastic retaining lance 12 to elastically deform upwardly. As a result, the front end of the female terminal 20 passes the slanting surface 12*a* of the retaining lance 12 to further advance in the direction of arrow Z.

Thus, the female terminal 20 further advances, with the retaining wall 20*c* held in sliding contact with the slanting surface 12*a* of the elastically-deformed retaining lance 12, and reaches a predetermined position whereupon the front end of the retaining lance 12 becomes fitted in the retaining hole 22. At this time, the retaining lance 12 is restored from the elastically-deformed condition to its original condition.

As a result, a step portion at the front end of the retaining lance 12 is engaged with the edge of the retaining hole 22, thereby retaining the female terminal 20 in the housing 11.

However, when the above conventional female terminal 20 is inserted into the housing 11, the front end of the female terminal is sometimes caught by the elastic retaining lance 12, and hence is not smoothly inserted into the predetermined position. If the female terminal is forcibly inserted, the retaining lance 12 may be damaged, or may be plastically deformed in an unrestorable manner, so that the retaining lance may lose the function of retaining the connection terminal.

More specifically, the two sharp edges 23*a* at the front end of the female terminal 20, contacting with the slanting surface 12*a* of the retaining lance 12 during the insertion, may damage this slanting surface 12*a*, which results in a possibility that the female terminal 20 can not be retained properly.

SUMMARY OF THE INVENTION

The present invention has been made in view of the above problem, and an object of the invention is to provide a female terminal which can be smoothly inserted into a housing without damaging a retaining lance, and can be easily retained without fail.

The above object has been achieved by a female terminal including an electrical contact portion of a cross-sectionally square, tubular configuration formed at its front portion for receiving a mating male terminal, and a wire connection portion formed at its rear portion for clamping a conductor and a sheath of a wire, wherein at least one side wall of the cross-sectionally square, tubular portion defining the electrical contact portion serves as a retaining wall; a retaining hole for being retainingly engaged with a retaining lance provided in a terminal receiving chamber in a connector housing is formed through the retaining wall generally centrally of a width of the retaining wall; and a notch is formed in a central portion of a front end of the retaining wall by a pair of slanting piece portions at the front end of the female terminal, disposed respectively on opposite sides of the notch, the slanting piece portions being curved inwardly relative to the cross-sectionally square, tubular portion.

The above object can be achieved more effectively if a width of that portion forming slanting surfaces of the slanting piece portions is larger than the width of the retaining lance formed in the terminal receiving chamber of the connector housing into which the female terminal is to be inserted.

In the female terminal of the present invention, the slanting piece portions, curved inwardly relative to the cross-sectionally square, tubular portion, are provided respectively on the opposite sides of the notch at the front end of the female terminal. With this construction, when the female terminal is inserted into the terminal receiving chamber in the housing, the slanting piece portions are brought into contact with a slanting surface of the retaining lance in the terminal receiving chamber. At this time, the slanting piece portions are smoothly brought into sliding contact with the slanting surface of the retaining lance to elastically deform the elastic retaining lance in a proper manner. As a result, the female terminal can be inserted into a predetermined position in the terminal receiving chamber without damaging or plastically deforming the retaining lance, while maintaining the elasticity of the retaining lance. As a result, the slanting surface of the retaining lance is fitted in the retaining hole, and is restored from the elastically-deformed condition to its original condition, thereby positively retaining the female terminal in the housing.

DETAILED DESCRIPTION OF THE PREFERRED EMBODIMENTS

Figure 1:
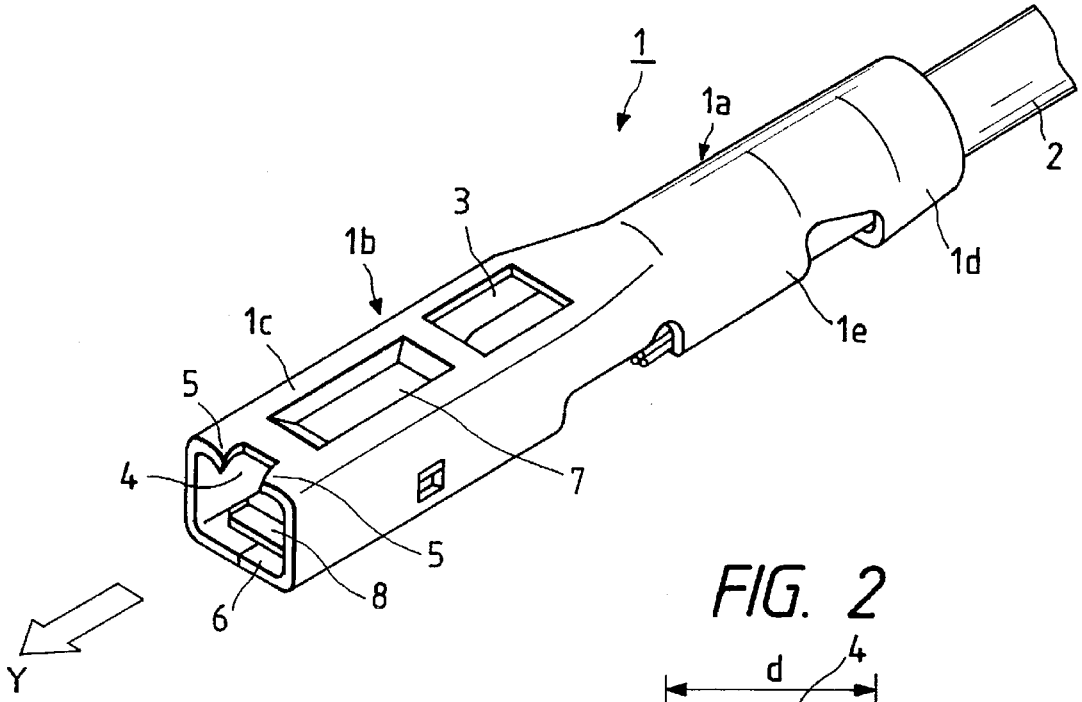
FIG. 1 is a perspective view of one preferred embodiment of a female terminal the present invention.
Figure 3:
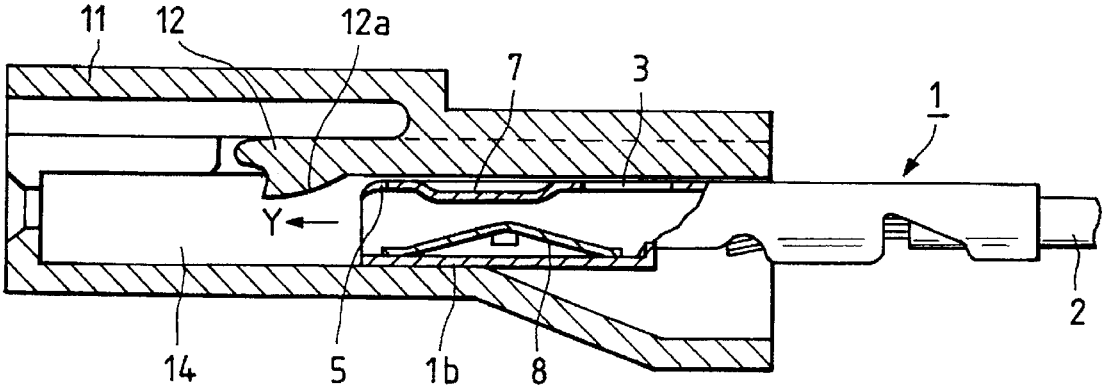
FIG. 3 is a cross-sectional view showing a condition in which the insertion of the female terminal into a housing begins.
Figure 4:
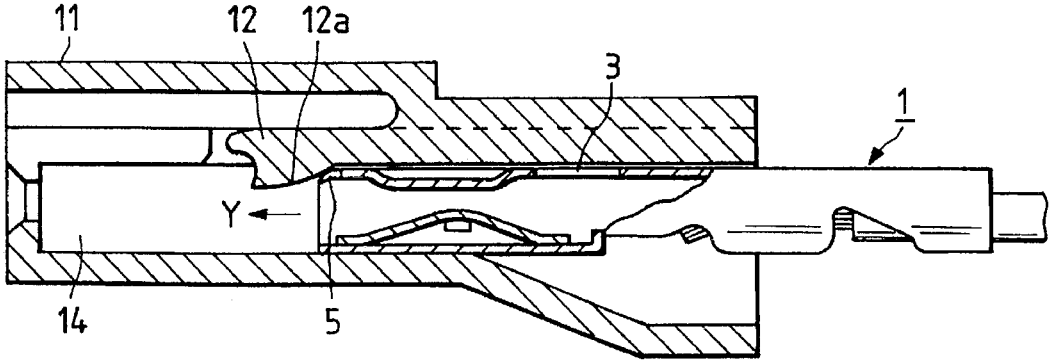
FIG. 4 is a cross-sectional view showing a condition in the process of insertion of the female terminal of FIG. 1 into the housing.
Figure 5:
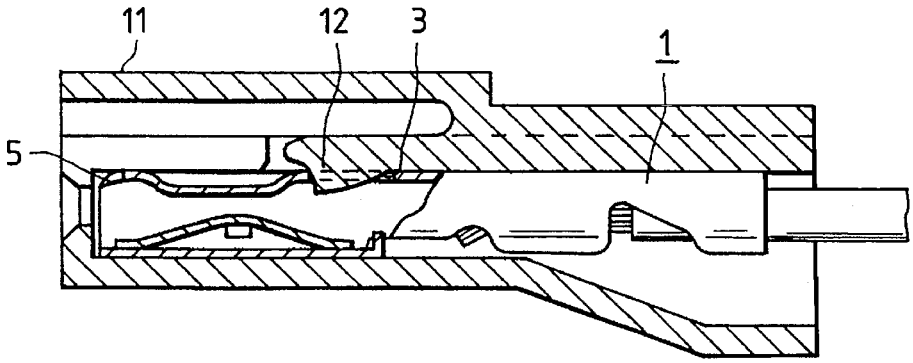
FIG. 5 is a cross-sectional view showing a condition in which the female terminal of FIG. 1 is inserted into a proper position.
Figure 6:
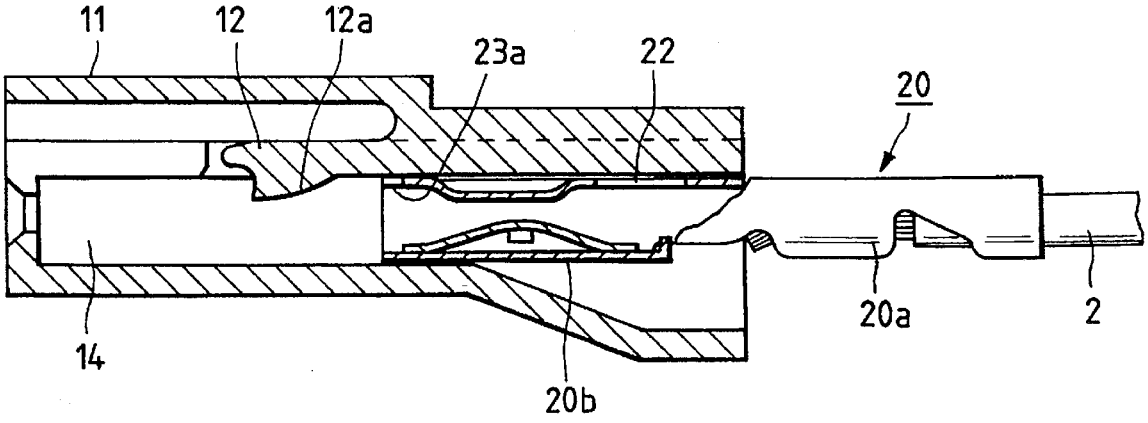
PRIOR ART FIG. 6
FIG. 6 is a cross-sectional view showing a condition in which the insertion of a conventional female terminal into a housing begins.
Figure 7:
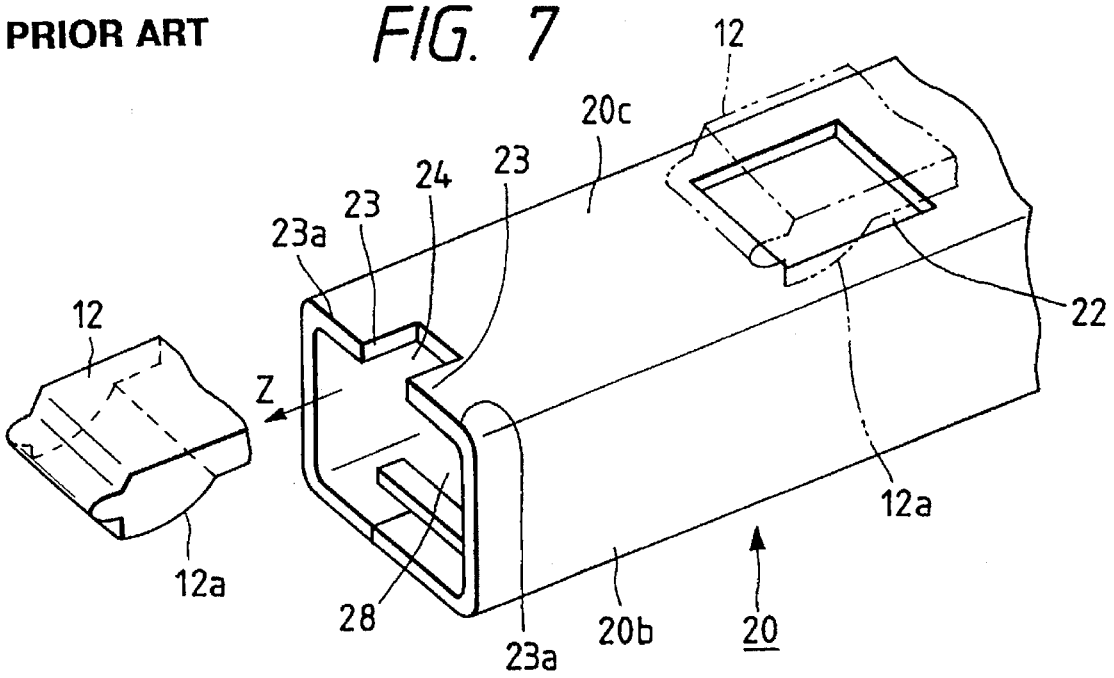
PRIOR ART FIG. 7
FIG. 7 is a fragmentary, perspective view showing a condition in which the female terminal of FIG. 6 is inserted and retained.
Figure 8:
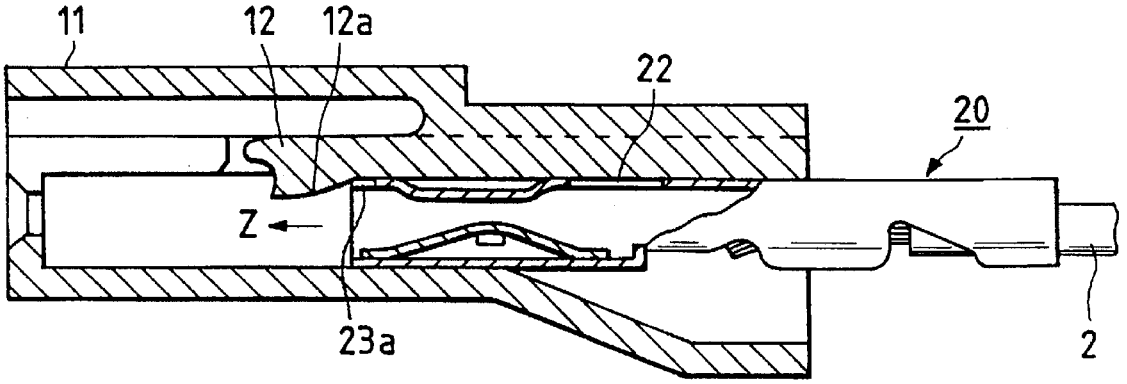
PRIOR ART FIG. 8
FIG. 8 is a cross-sectional view showing a condition in the process of insertion of the female terminal of FIG. 6 into the housing.

A preferred embodiment of a female terminal according to the present invention will now be described with reference to FIGS. 1 to 5. FIG. 1 is a perspective view of one preferred embodiment of the female terminal of the invention, FIG. 2 is a front-elevational view of the terminal as seen from its front side in a direction opposite to a direction of arrow Y of FIG. 1, FIG. 3 is a cross-sectional view showing a condition in which the insertion of the female terminal into a housing begins, FIG. 4 is a cross-sectional view showing a condition in the process of insertion of the female terminal, and FIG. 5 is a cross-sectional view showing a condition in which the female terminal is inserted into a proper position.

As shown in FIG. 1, the female terminal 1 has an electrical contact portion 1*b* of a cross-sectionally square, tubular configuration at its front end portion, and a wire connection portion 1*a* at its rear end portion. At least one wall of the electrical contact portion 1*b* serves as a retaining wall 1*c* having a retaining hole 3 of a rectangular shape formed therethrough centrally of the width thereof. A notch 4 of a rectangular shape is formed in a front end of the retaining wall 1*c* at a central portion thereof. For securing an electrical contact between the female terminal 1 and a mating male terminal (which is inserted into the female terminal through a terminal insertion opening 6 at the front end of the female terminal), a resilient contact plate 8 is provided within the electrical contact portion 1*b*, and an upper plate portion 7 is formed on the electrical contact portion 1*b*. A mounting tool for mounting the resilient contact plate 8 is introduced into the electrical contact portion 1*b* through the notch 4.

The wire connection portion 1*a* includes a sheath clamping portion 1*d* for gripping an insulative sheath of a wire 2 to secure the wire 2 to the female terminal 1, and a conductor clamping portion 1*e* for gripping a conductor of the wire 2 to electrically connect the conductor to the female terminal.

Figure 2:
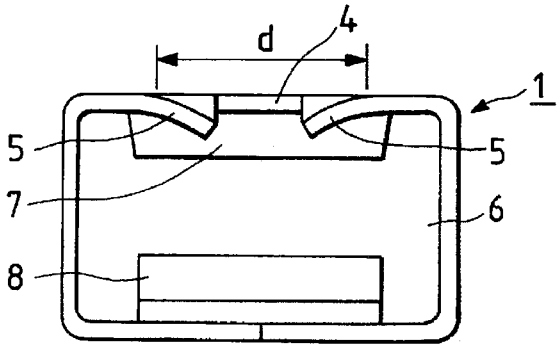
FIG. 2 is a front-elevational view of the terminal as seen from its front side in a direction opposite to a direction of arrow Y of FIG. 1.

As best shown in FIG. 2, opposite side portions of the front end of the female terminal spaced from each other by the notch 4 are bent inwardly at their inner end portions to provide curved, slanting piece portions 5 and 5, respectively. The width d of that portion forming this slanting area is larger than the width of a retaining lance (described later) provided within the housing.

For inserting and retaining the female terminal 1 of the above construction relative to the housing, the female terminal 1 is first inserted into a terminal receiving chamber 14 in the housing 11 from a rear end (right end in the drawings) of this housing, with the electrical contact portion 1*b* directed forwardly, as shown in FIG. 3.

Then, when the female terminal 1 is further advanced in the direction of arrow Y as shown in FIG. 4, the slanting piece portions 5, provided respectively on opposite sides of the notch 4, are brought into contact with a slanting surface 12*a* of the elastic retaining lance 12 formed within the housing 11. At this time, the female terminal 1 is smoothly guided into the terminal receiving chamber 14 along the retaining lance 12 since the width d of that portion forming the slanting area is larger than the width of the retaining lance 12. The slanting piece portions 5 are formed into a curved shape, and therefore the female terminal 1 is smoothly brought into sliding contact with the slanting surface 12*a*, and can be advanced with a low insertion force.

When the female terminal 1 is further advanced in the direction of arrow Y, the slanting surface 12*a* rests on the downwardly-slanting piece portions 5 of the female terminal 1, so that the retaining lance 12 is urged upward and elastically deformed. As a result, the female terminal 1 further advances in the direction of arrow Y, so that the front end of the female terminal 1 passes the slanting surface 12*a* of the retaining lance 12. The female terminal 1 further advances with the retaining wall 1*c* held in sliding contact with the slanting surface 12*a* of the elastically-deformed retaining lance 12, and reaches a predetermined inserted position.

As a result, the slanting surface 12*a* of the retaining lance 12 is fitted in the retaining hole 3 in the female terminal 1, so that the retaining lance 12 is restored from the elastically-deformed condition to its original condition, as shown in FIG. 5. At this time, the front end or edge of the retaining lance 12 engages the edge of the retaining hole 3, thereby retaining the female terminal 1 in a proper condition within the housing 11.

As described above, each of the slanting piece portions 5 has a curved surface slanting downwardly in the direction of advance of the female terminal 1, and therefore the front end of the female terminal 1 will not strike hard against the slanting surface 12*a* of the retaining lance 12, but is smoothly brought into contact with the slanting surface 12*a* to urge the same upward.

Therefore, the front end of the female terminal will not damage or cut the retaining lance 12, and will not damage the slanting surface 12*a*, and can move into the predetermined position past the elastic retaining lance 12 without any trouble.

The slanting piece portions 5 can be easily formed by plastical working using a jig, or by dies. However, it is necessary to limit the inclination of the slanting piece portions 5 and 5 so that the lower ends of these portions 5 will not contact or interfere with the mating male terminal to be inserted into the female terminal.

The slanting surface of the slanting piece portions 5 may simply be a flat surface, and the angle of inclination thereof, as well as the width of this slanting surface, is not particularly limited in so far as the slanting piece portions do not prevent the insertion of the male terminal.

As described above, in the female terminal of the present invention, the slanting piece portions, curved inwardly relative to the cross-sectionally square, tubular portion, are provided respectively on opposite sides of the notch at the front end of the female terminal.

With this construction, when the female terminal is inserted into the terminal receiving chamber in the housing, the slanting piece portions provided at the front end of the female terminal are brought into contact with the slanting surface of the retaining lance to elastically deform the elastic retaining lance in a gentle manner, so that the female terminal can be smoothly inserted into the terminal receiving chamber.

Therefore, damage to the retaining lance and the slanting surface thereof by the front end of the female terminal can be positively avoided, and the female terminal can be inserted into the housing with a low insertion force. Therefore, the efficiency of the inserting operation can be greatly enhanced.

What is claimed is:

1. A female terminal for insertion into a terminal receiving chamber of a connector housing and for engagement with a retaining lance provided in said connector housing, comprising:

an electrical contact portion having a square cross-section, said electrical contact portion comprising a front portion at its front end for receiving a mating male terminal, said front portion having a retaining wall, said retaining wall being that wall of said terminal that faces and retains said lance when said terminal is inserted in said connector housing;

a wire connection portion formed at its rear portion for clamping a conductor and a sheath of a wire;

a retaining hole for engaging said retaining lance, said retaining hole being formed through said retaining wall generally centrally of a width of said retaining wall;

a notch formed in a central portion of a front end of said retaining wall; and a pair of slanting piece portions formed at the front end of said retaining wall, and disposed respectively on opposite sides of said notch, said slanting piece portions being curved inwardly relative to said square cross-section of said front portion.

2. A female terminal as claimed in claim 1, wherein a width defined between slanting surfaces of said slanting piece portions is larger than the width of said retaining lance formed in said terminal receiving chamber of said connector housing into which said female terminal is to be inserted.

* * * * *